United States Patent [19]

Kondo et al.

[11] 4,110,110

[45] Aug. 29, 1978

[54] NICKEL-BASE ALLOY EXCELLENT IN CORROSION RESISTANCE AT HIGH TEMPERATURES

[75] Inventors: Tatsuo Kondo, Mito; Masami Shindo, Tokai; Taizo Ohmura; Noboru Yonezawa, both of Ohmiya; Akira Kawagoe, Kitamoto; Toshio Kojima, Okegawa, all of Japan

[73] Assignee: Mitsubishi Kinzoku Kabushiki Kaisha, Otemachi, Japan

[21] Appl. No.: 712,760

[22] Filed: Aug. 9, 1976

[30] Foreign Application Priority Data

Aug. 27, 1975 [JP] Japan ..... 50-103047
Aug. 27, 1975 [JP] Japan ..... 50-103048

[51] Int. Cl.[2] ..... C22C 19/05

[52] U.S. Cl. ..... 75/122; 75/134 F; 75/171; 148/32

[58] Field of Search ..... 75/171, 170, 122, 134 F; 148/32, 32.5

[56] References Cited

U.S. PATENT DOCUMENTS 2,703,277 3/1955 Spendelow et al. ..... 75/171
3,865,581 2/1975 Sekino et al. ..... 75/171

*Primary Examiner*—R. Dean
*Attorney, Agent, or Firm*—Flynn & Frishauf

[57] ABSTRACT

A nickel-base alloy excellent in corrosion resistance at high temperatures, which consists essentially of, in weight percentage:

Carbon — 0.04 to 0.25%,
Chromium — 10.0 to 25.0%,

At least one element selected from the group consisting of 0.1 to 30.0% iron, 0.1 to 25.0% tungsten, 0.1 to 10.0% molybdenum and 0.05 to 30.0% cobalt — 50.0% at the maximum, Manganese — 0.4 to 1.5%,
Silicon — 0.05 to 0.5%, preferably 0.05 to 0.2%, and
Nickel and inevitable impurities — balance;

said alloy having excellent corrosion resistance at high temperatures in an atmosphere of a low oxidizing potential.

Said alloy contains, as required, the following additional elements:

Boron — 0.001 to 0.05%,
Zirconium — 0.1 to 0.1%, and

At least one element selected from the group consisting of 0.001 to 0.02% magnesium, 0.001 to 0.05% calcium and 0.001 to 0.02% rare earth elements.

10 Claims, 6 Drawing Figures

NICKEL-BASE ALLOY EXCELLENT IN CORROSION RESISTANCE AT HIGH TEMPERATURES

FIELD OF THE INVENTION

The present invention relates to a nickel-base alloy having excellent high-temperature corrosion resistance in an atmosphere of a low oxidizing potential, for example of an inert gas such as helium or argon or under vacuum.

BACKGROUND OF THE INVENTION

Nickel-base super alloys consisting essentially of the following chemical compositions in weight percentage are conventionally known as alloys excellent in high-temperature corrosion resistance in the open air and other strongly oxidizing atmospheres:

(1) Carbon — 0.04 to 0.25%,

Chromium — 10.0 to 25.0%,

At least one element selected from the group consisting of 0.1 to 30.0% iron, 0.1 to 10.0% tungsten, 0.1 to 10.0% molybdenum and 0.05 to 30.0% cobalt — 50.0% of the maximum, and Nickel and inevitable impurities: balance;

(2) The constituents described in (1) above, and additionally,

Boron — 0.001 to 0.05%,

Zirconium — 0.01 to 0.1%, and

At least one element selected from the group consisting of 0.001 to 0.02% magnesium, 0.001 to 0.05% calcium and 0.001 to 0.02% rare earth elements;

(3) Carbon — 0.04 to 0.25%,

Chromium — 10.0 to 25.0%,

Tungsten — 10.0 to 25.0%,

Molybdenum — 0.1 to 10.0%, (Tungsten) + 2(Molybdenum) being 25.0% at the maximum, Boron — 0.001 to 0.05%, Zirconium — 0.01 to 0.1%, At least one element selected from the group consisting of 0.001 to 0.02% magnesium, 0.001 to 0.05% calcium and 0.001 to 0.02% rare earth elements; and Nickel and inevitable impurities — balance.

In the conventional nickel-base super alloys having the aforementioned chemical compositions, chromium serves to improve the oxidation resistance of the alloys at high temperatures irrespective of the the oxidizing potential of atmosphere. These alloys therefore contain at least 10.0% chromium to achieve a desired oxidation resistance at high temperatures. With a chromium content of over 25.0%, however, the mechanical strength and the workability of the alloys are degraded. An upper limit of 25.0% is therefore established. Also, carbon serves to strengthen the alloy base and to stabilize the metallographical structure. A carbon content of over 0.25% makes it difficult to conduct a plastic working of the alloy, whereas a carbon content of under 0.04% cannot give a desired effect. Appropriate carbon contents are consequently limited to the range from 0.04 to 0.25%. Moreover, at least one element from among iron, tungsten, molybdenum and cobalt is included to intensify the solid-solution with a view to improving the mechanical properties and the workability of Ni-Cr alloys, and the contents are limited to the values specified above for obtaining desired effects. Boron, zirconium and at least one element from among magnesium, calcium and rare earth elements, with contents specified as above, are included as required, to improve the high-temperature creep property and strengthen grain boundaries of the alloy.

The conventional nickel-base super alloys mentioned above exhibit excellent corrosion resistance at high temperatures in a strongly oxidizing atmosphere such as the air. However, these super alloys, when used in an atmosphere of a low oxidizing potential, for example under vacuum or in high-temperature inert gas as in a high-temperature gas-cooled reactor with helium as the cooling medium, which has recently appeared, do not exhibit sufficient corrosion resistance at high temperatures and cannot withstand corrosion at high temperatures.

The reasons are as follows: when the aforementioned conventional nickel-base super alloys are placed in a strongly oxidizing atmosphere, the solid-solution-intensifying elements contained therein are almost totally oxidized to form such spinel oxides as $NiCr_2O_4$ and $FeCr_2O_4$. These spinel oxides, which are dense and adhere well to the alloy surface after once formed on the alloy surface, serve to inhibit the oxidation of the alloys thereafter. This is why these conventional super alloys exhibit excellent corrosion resistance at high temperatures in a strongly oxidizing atmosphere.

On the other hand, an atmosphere, even of an inert gas such as helium or argon or even under vacuum, practically contains at least one trace impurity from among oxygen, nitrogen, carbon monoxide, moisture, hydrogen and inorganic hydro-carbon. Said atmosphere of an inert gas or under vacuum has therefore often a low oxidizing potential (i.e., a weakly oxidizing atmosphere), and an alloy is not always free from corrosion by oxidation in such an atmosphere. In a strongly oxidizing atmosphere such as the air, a spinel oxide film consisting of composite compounds mainly comprising chromium is immediately formed and this film serves to prevent oxidation of an alloy thereafter. This spinel oxide film is hardly formed in the above-mentioned atmosphere of a low oxidizing potential. As a result, when the conventional nickel-base super alloy is exposed to the above-mentioned atmosphere of a low oxidizing potential, an oxide film slightly formed on its surface is easily spalled off, or selective oxidation of grain boundaries and internal oxidation proceed. The conventional super alloys cannot therefore sufficiently withstand corrosion at high temperatures.

In view of the foregoing, there has been a demand for an alloy showing excellent corrosion resistance at high temperatures in an atmosphere of a low oxidizing potential, but an alloy having such a property has not as yet been proposed.

SUMMARY OF THE INVENTION

A principal object of the present invention is therefore to provide a nickel-base alloy excellent in corrosion resistance at high temperatures showing excellent high-temperature corrosion resistance in an atmosphere of a low oxidizing potential, for example of an inert gas such as helium or argon or under vacuum.

Another object of the present invention is to provide a nickel-base alloy excellent in corrosion resistance at high temperatures having an oxide film formed on the surface thereof not spalling off in the above-mentioned atmosphere of a low oxidizing potential.

Further, another object of the present invention is to provide a nickel-base alloy excellent in corrosion resistance at high temperatures and not susceptible to selective oxidation of grain boundaries and internal oxidation in the above-mentioned atmosphere of a low oxidizing potential.

In accordance with one of the features of the present invention, there is provided a nickel-base alloy excellent in corrosion resistance at high temperatures, which consists essentially of:

Carbon — 0.04 to 0.25%,

Chromium — 10.0 to 25.0%,

At least one element selected from the group consisting of 0.1 to 30.0% iron, 0.1 to 25.0% tungsten, 0.1 to 10.0% molybdenum and 0.05 to 30.0% cobalt — 50.0% at the maximum, and Nickel and inevitable impurities — balance; characterized by further additionally containing:

Manganese — 0.4 to 1.5%, and

Silicon — 0.05 to 0.5%, preferably 0.05 to 0.2%; said alloy having excellent corrosion resistance at high temperatures in an atmosphere of a low oxidizing potential.

Said alloy further additionally contains as required the following elements:

Boron — 0.001 to 0.05%,

Zirconium — 0.01 to 0.1%, and

At least one element selected from the group consisting of 0.001 to 0.02% magnesium, 0.001 to 0.05% calcium and 0.001 to 0.02% rare earth elements.

BRIEF DESCRIPTION OF THE DRAWINGS

The present invention is illustrated by way of examples in the accompanying drawings which form part of this application and in which:

FIG. 1(*b*) is a photograph showing the cross-sectional structure of a specimen of a reference alloy outside the scope of the present invention near the surface of the center portion, taken in a high-temperature corrosion test;

FIG. 5(*b*) is a photograph showing the state of the surface of a specimen of a reference alloy outside the scope of the present invention, taken in a high-temperature corrosion resistance;

FIG. 8(*b*) is a photograph showing the cross-sectional structure of a specimen of another reference alloy outside the scope of the present invention near the surface of the center portion, taken in a high-temperature corrosion test.

DETAILED DESCRIPTION OF PREFERRED EMBODIMENTS

Figure 1A:
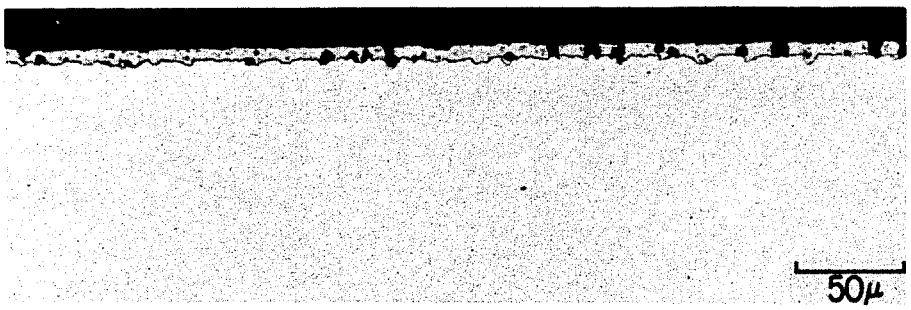
FIG. 1(*a*) is a photograph showing the cross-sectional structure of a specimen of an alloy of the present invention near the surface of the center portion, taken in a high-temperature corrosion test.

From the aforementioned point of view, we have carried out extensive studies with a view to improving the above-mentioned conventional nickel-base super alloys so as to withstand sufficiently corrosion at high temperatures in an atmosphere of a low oxidizing potential, for example of an inert gas such as helium or argon or under vacuum, and as a result, found that a nickel-base alloy excellent in corrosion resistance at high-temperatures in an atmosphere of a low oxidizing potential, which has an oxide film formed on the surface thereof not spalling off, gives only slight high-temperature corrosion by oxidation, and hardly susceptible to selective oxidation of grain boundaries and internal oxidation, can be obtained, by adding in melting the aforementioned conventional nickel-base super alloys, in weight percentage:

Manganese — 0.4 to 1.5%, and

Silicon — 0.05 to 0.5%, preferably 0.05 to 0.2%, and further preferably by limiting the contents of aluminium and titanium as follows:

Aluminium — 0.001 to 0.2%, and

Titanium — 0.001 to 0.05%.

The following paragraphs describe the reasons why the contents of manganese and silicon, and further if necessary, of aluminium and titanium are limited as described above in the nickel-base alloy excellent in corrosion resistance at high temperatures of the present invention.

(1) Manganese

Manganese is oxided in an atmosphere of a low oxidizing potential to form spinel oxides mainly comprising $MnCr_2O_4$ on the surface of the oxide film of an alloy. However, because a manganese content of under 0.4% cannot form a firm spinel oxide film in an amount sufficient to prevent oxidation corrosion of the alloy, it is necessary for the alloy to contain at least 0.4% manganese. On the other hand, since a manganese content of over 1.5% impairs the high-temperature workability of the alloy, manganese content should not be over 1.5%.

(2) Silicon

Addition of silicon to an alloy has generally been considered to accelerate the selective oxidation of grain boundaries and the spalling of an oxide film, whereas we have discovered that the addition of 0.05% silicon at the minimum, together with manganese, can prevent spalling of the oxide film and inhibit occurrence of selective oxidation of grain boundaries. However, because a silicon content of under 0.05% cannot exert a desirable effect of preventing spalling of the oxide film, the alloy should contain 0.05% silicon at the minimum. On the other hand, a silicon content of over 0.5% causes occurrence of "whisker crystals", which are oxides.

The whisker crystals referred to above are oxides developing as lean and long acicular crystals, about 0.5μ in diameter and about 10 to 50μ in length, on the surface layer of an alloy in high-temperature oxidation of an alloy in an atmosphere of a low oxidizing potential, for example, of an inert gas such as helium or argon or under vacuum. These whisker crystals are considered to be caused by the sublimation and evaporation of oxides. An alloy easily susceptible to these whisker crystals is substantially wearable by high-temperature oxidation in an atmosphere of a low oxidizing potential, and often causes contamination of surrounding parts. Silicon content should not therefore be over 0.5%, preferably not over 0.2%.

(3) Aluminium

Aluminium is usually added as a deoxidizing agent in melting an alloy in many cases. Especially when the smallest possible content of titanium is desired, as described later, titanium cannot be used as a deoxidizing agent. In such cases, it is often required to employ aluminium as a deoxidizing agent. However, the aluminium added as a deoxidizing agent inevitably remains in the product alloy. When an alloy contains over 0.05% aluminium, it is impossible to prevent selective oxidation of grain boundaries of the alloy in an atmosphere of a low oxidizing potential. Because the selective oxidation of grain boundaries of an alloy cannot be prevented unless the aluminium content is reduced to such a very low level, very strict restricting conditions are applied in the melting step of an alloy.

In the alloy of the present invention, in contrast, an aluminium content of up to 0.2% in the alloy does not cause said selective oxidation of grain boundaries by the effect of the combined addition of manganese and silicon, thus providing favorable effects in melting an alloy and casting it into ingots.

(4) Titanium

Since titanium is the most detrimental element accelerating selective oxidation of grain boundaries, it is not desirable to add titanium over 0.05% to an alloy.

Now, the present invention is described more in detail by way of examples by comparing an alloy of the present invention with reference alloys outside the scope of the present invention.

EXAMPLE 1

Raw materials were blended so as to give final chemical compositions as shown in Table 1, Table 1

| Alloy specimen No. | | Chemical composition (wt. %) | | | | | | | | | | | | | | Other elements | Ni |
|---|---|---|---|---|---|---|---|---|---|---|---|---|---|---|---|---|---|
| | | Mn | Si | Al | Ti | C | Cr | Fe | Mo | W | Co | B | Zr | Mg | Ca | | |
| Alloy of this invention | 1 | 0.64 | 0.39 | 0.09 | tr. | 0.07 | 21.4 | 17.8 | 9.0 | 0.60 | 0.51 | 0.015 | 0.02 | — | | | bal. |
| | 2 | 1.25 | 0.30 | 0.07 | tr. | 0.07 | 21.5 | 17.8 | 8.9 | 0.55 | 0.51 | — | 0.03 | 0.017 | | | " |
| | 3 | 0.75 | 0.15 | tr. | tr. | 0.15 | 12.5 | 0.2 | 5.0 | 4.50 | 0.50 | 0.012 | — | — | 0.002 | | " |
| | 4 | 0.85 | 0.30 | tr. | tr. | 0.20 | 23.5 | 0.2 | 5.5 | tr. | 25.30 | — | 0.03 | — | | La: 0.02 | " |
| | 5 | 0.92 | 0.17 | tr. | tr. | 0.05 | 20.3 | 5.3 | tr. | tr. | 23.50 | — | — | — | | Ce: 0.01 | " |
| | 6 | 0.65 | 0.07 | tr. | tr. | 0.07 | 21.3 | 17.9 | 9.0 | 0.60 | 0.51 | 0.017 | 0.03 | — | | | " |
| Reference alloy | 7 | 0.36 | 0.52 | 0.30 | tr. | 0.08 | 21.3 | 17.9 | 9.0 | 0.57 | 0.79 | 0.010 | 0.03 | — | | | " |
| | 8 | 0.04 | 0.42 | 1.20 | 0.35 | 0.03 | 20.5 | tr. | 8.5 | tr. | 12.00 | — | — | — | | Nb + Ta: 3.42 | " |
| | 9 | 0.09 | 0.05 | 0.15 | tr. | 0.07 | 21.3 | 17.8 | 8.9 | 0.56 | 0.52 | — | — | — | | | " |
| | 10 | 1.20 | 0.03 | 0.05 | tr. | 0.08 | 20.9 | 17.7 | 9.0 | 0.55 | 0.51 | — | — | — | | | " |

and said blended raw materials were melted in a high-frequency induction vacuum furnace and cast into respective ingots. Said respective ingots were subjected to a soaking treatment by holding at about 1,200° C. for 24 hours, and then forged and rolled into alloy sheets having a thickness of 1.7 mm. Then, said respective alloy sheets were subjected to a solution treatment at 1,150° C., and after this treatment, pieces of dimensions of 1 mm × 10 mm × 20 mm were cut from said respective alloy sheets. These pieces were finally finished by polishing with a # 1,200 emery paper, subjected to an ultrasonic cleaning in an acetone bath, and furthermore dried under vacuum. Alloy specimens Nos. 1 to 6 within the scope of the present invention and reference alloy specimens Nos. 7 to 10 outside the scope of the present invention shown in Table 1, which were thus obtained, were subjected to a high-temperature corrosion test.

Said high-temperature corrosion test was carried out under the following conditions by placing each alloy specimen in a retort made of quartz:

(1) Heating temperature: 1,000° C.

(2) Atmosphere and heating time:

(a) 300 hours and 500 hours in a helium gas atmosphere similar to that in a high-temperature gas-cooled reactor with helium gas as cooling medium, (b) 300 hours in an argon gas atmosphere, (c) 300 hours under a vacuum of $10^{-3}$ mm Hg.

(3) Flow rate of said helium and argon:

100 cc per minute per 1 $cm^2$ surface area of alloy specimen.

As shown in Table 2, almost no difference in the chemical composition of gas was observed between the gas inlet and the gas outlet of said retort.

Table 2

| Composition | He gas (p.p.m.) | | Ar gas (p.p.m.) | |
|---|---|---|---|---|
| | Inlet | Outlet | Inlet | Outlet |
| $H_2$ | 97–103 | 98–103 | 95–100 | 97–102 |
| CO | 94–98 | 93–97 | 93–97 | 91–96 |
| $CO_2$ | 2.5–2.8 | 2.6–2.9 | 2.4–2.8 | 2.5–2.8 |
| $CH_4$ | 5.1–5.4 | 5.2–5.4 | 5.0–5.3 | 4.9–5.4 |
| $H_2O$ | 8–10 | 6–10 | 8–10 | 7–11 |
| $N_2$ | <4 | <4 | <4 | <4 |
| $O_2$ | <1 | <1 | <1 | <1 |

In the above-mentioned high-temperature corrosion test, the increment in weight caused by oxidation (hereinafter called "oxidation increment" of each alloy specimen was measured. The results are indicated in Table 3.

Table 3

| Alloy specimen No. | | In He gas ($mg/cm^2$) | | In Ar gas ($mg/cm^2$) | Under vacuum ($mg/cm^2$) |
|---|---|---|---|---|---|
| | | Heated for 300 hr. | Heated for 500 hr. | Heated for 300 hr. | Heated for 300 hr. |
| Alloy of this invention | 1 | 1.0 | 1.1 | 0.9 | −0.7 |
| | 2 | 0.5 | 0.7 | 0.5 | −0.5 |
| | 3 | 0.9 | 1.0 | 0.9 | −0.5 |
| | 4 | 0.8 | 0.8 | 0.8 | −0.4 |
| | 5 | 0.6 | 0.8 | 0.7 | −0.4 |
| | 6 | 1.0 | 1.1 | 0.9 | −0.6 |
| Reference alloy | 7 | 1.3 | 1.6 | 1.4 | −1.4 |
| | 8 | 1.9 | 2.5 | 2.0 | −1.2 |
| | 9 | 1.5 | 2.0 | 1.6 | −1.2 |

Table 3-continued

| Alloy specimen No. | In He gas (mg/cm²) Heated for 300 hr. | In He gas (mg/cm²) Heated for 500 hr. | In Ar gas (mg/cm²) Heated for 300 hr. | Under vacuum (mg/cm²) Heated for 300 hr. |
|---|---|---|---|---|
| 10 | 1.2 | 1.6 | 1.5 | −1.3 |

As is evident from Table 3, as compared with the reference alloy specimens Nos. 7 to 10 outside the scope of the present invention, the alloy specimens Nos. 1 to 6 of the present invention showed in all cases a far smaller oxidation increment in any of the atmospheres used. Especially in the helium gas atmosphere, there was no remarkable difference in the oxidation increment between the two heating periods of 300 and 500 hours. This indicates that an oxide film, once formed on the surface of an alloy of the present invention, effectively prevents further oxidation of the alloys. The excellent corrosion resistance of the alloy of the present invention at high temperatures in an atmosphere of a low oxidizing potential is clearly known from this fact.

Figure 3:
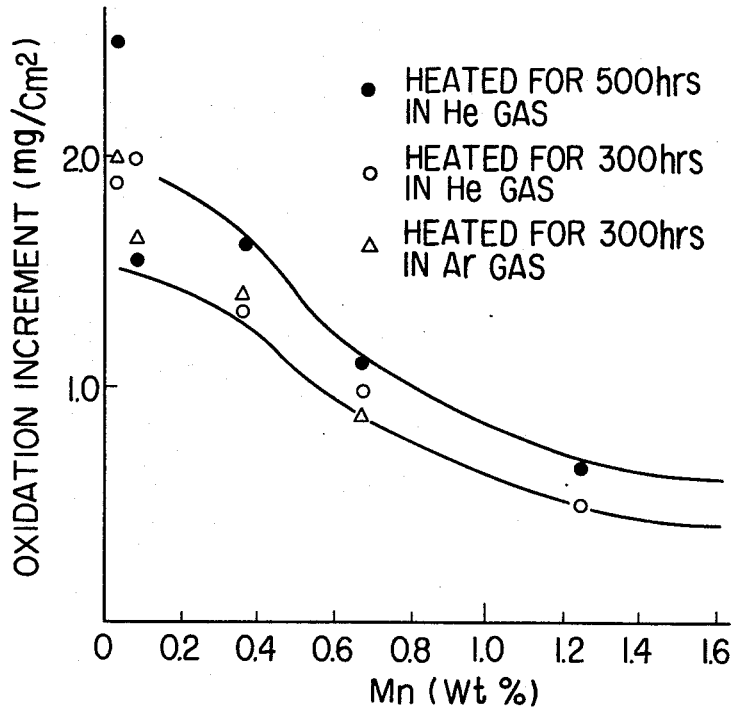
FIG. 3 is a drawing illustrating the relation between the manganese content in an alloy and the increment in weight caused by high-temperature oxidation.

FIG. 3 shows the relation between the manganese content and the oxidation increment of alloy specimens when heated for 300 hours and 500 hours in helium and argon gases in said high-temperature corrosion test. As is clear from FIG. 3, the oxidation increment of the alloys decreases accordingly as the manganese content becomes higher. Especially with manganese contents of 0.4% or over, the decrease in the oxidation increment is remarkable.

Observation of the surfaces of the respective alloy specimens in said high-temperature corrosion test revealed no spalling of the oxide film in the alloy specimens Nos. 1 to 6 within the scope of the present invention. In contrast, spalling of the oxide film occurred in the reference alloy specimens Nos. 7 to 10 outside the scope of the present invention.

Figure 1B:
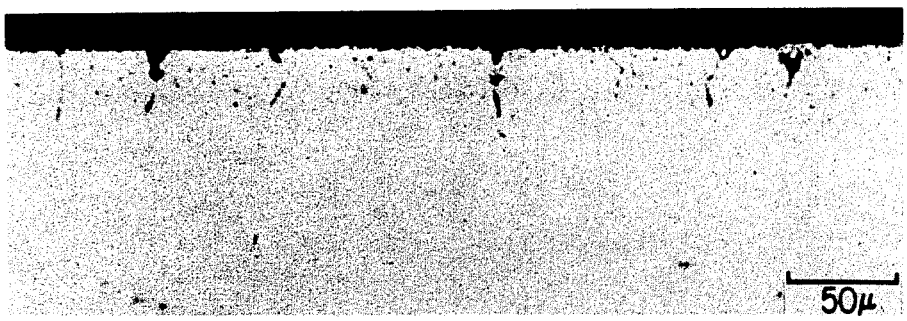

FIG. 1(a) and FIG. 1(b) are photographs showing the cross-sectional structures near the surfaces of the center portions of the alloy specimen No. 1 of the present invention and the reference alloy specimen No. 7 outside the scope of the present invention, respectively, taken in said high-temperature corrosion test. In alloy specimen No. 1, as shown in FIG. 1(*a*), the oxide film is dense under the effect of the combined addition of manganese and silicon, and at the same time, spalling of the oxide film, selective oxidation of grain boundaries and internal oxidation are completely nonexistent. Contrary to this, in reference alloy specimen No. 7, as shown in FIG. 1(*b*), there is observed a serious progress of selective oxidation of grain boundaries and internal oxidation, and moreover, the oxide film is partly spalled off. The cross-sectional structures given in FIG. 1(*a*) and FIG. 1(*b*) show three layers: a resin layer, an oxide film and the base metal, from top to bottom.

Figure 2:
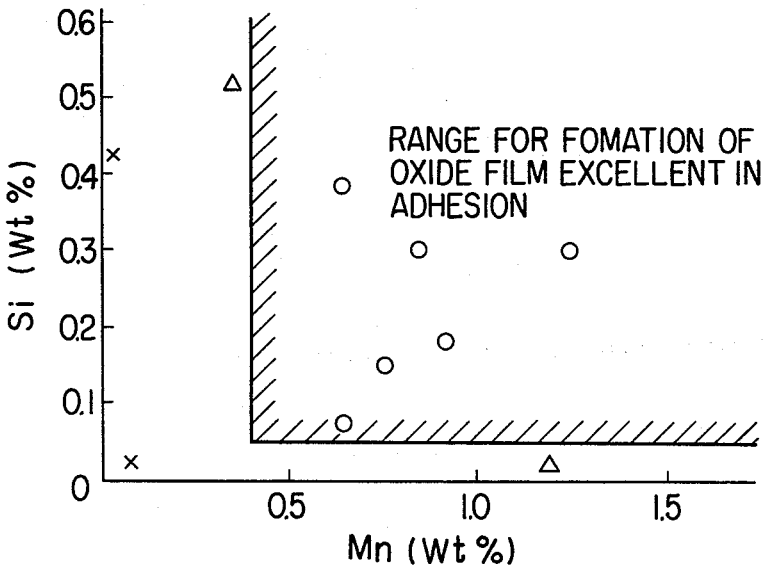
FIG. 2 is a drawing illustrating the effect of manganese and silicon on the occurrence of spalling of an oxide film formed on the surface of an alloy.

FIG. 2 shows the effect of manganese and silicon on the occurrence of spalling of an oxide film formed on the surface of an alloy, as derived from said high-temperature corrosion test. In FIG. 2, plots "*o*" indicate non-existence of spalling of an oxide film, plots "*x*" indicate serious spalling of an oxide film, and plots "Δ", slight spalling of an oxide film. By singly adding manganese, it is possible to prevent spalling of the oxide film, though slightly, as shown in FIG. 2. However, the combined addition of manganese and silicon can further improve the prevention of spalling of the oxide film; especially within the range of manganese contents of 0.4% and over, and of silicon contents of 0.05% and over, no spalling of the oxide film is observed.

Figure 4:
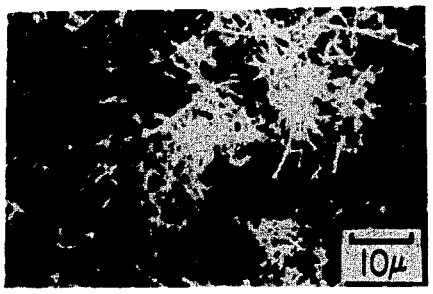
FIG. 4 is a scanning-type electron microphotograph showing the shape of oxides formed on the surface of a specimen of a reference alloy outside the scope of the present invention, taken in a high-temperature corrosion test.

In the observation of the shape of oxides formed on the surface of the tested alloy specimens with a scanning-type electron microscope in said high-temperature corrosion test, whisker crystals were found only in a very slight amount in alloy specimens Nos. 1 to 6 of the present invention, whereas, in reference alloy specimen No. 7 outside the scope of the present invention, containing as much silicon as 0.52%, whisker crystals were observed in a far larger amount, as shown in FIG. 4. Further description is given in Example 2, as to the whisker crystals.

EXAMPLE 2

Raw materials were blended so as to give final chemical compositions as shown in Table 4, and said blended raw materials were melted in a high-frequency induction vacuum furnace and cast into respective ingots. Then, said respective ingots were refined by electroslag melting process. The ingots thus refined, after being held at a temperature of about 1,250° C. for 24 hours for soaking, were forged and rolled into alloy sheets of 3.5 mm in thickness. Each of the alloy sheets was subjected to a solution treatment at an appropriate temperature selected by tests made in advance with a view to determining the temperature for the solution treatment, so that each of said alloy sheets would have a grain size within the ranges of ASTM Nos. 1 to 4, and then a piece of 3 mm × 10 mm × 10 mm in dimensions was cut from each of said alloy sheets. Each of said pieces was then finally finished by polishing with a #1,500 emery paper, subjected to an ultrasonic cleaning in an acetone bath, and furthermore dried under vacuum. Alloy specimens Nos. 1 to 6 within the scope of the present invention and reference alloy specimens Nos. 7 to 19 outside the scope of the present invention shown in Table 4, which were thus obtained, were subjected to a high-temperature corrosion test.

Table 4

| Alloy specimen No. | | Chemical composition (wt. %) Mn | Si | Al | Ti | C | Cr | Fe | Mo | W | Co | B | Zr | Mg | Ca | Other elements | Ni |
|---|---|---|---|---|---|---|---|---|---|---|---|---|---|---|---|---|---|
| Alloy of this invention | 1 | 0.76 | 0.32 | 0.05 | tr. | 0.04 | 20.2 | — | — | 20.4 | — | 0.003 | 0.05 | 0.008 | — | — | bal |
| | 2 | 1.25 | 0.25 | 0.15 | tr. | 0.07 | 19.8 | — | — | 20.5 | — | 0.002 | 0.04 | — | — | La: 0.001 | " |
| | 3 | 0.80 | 0.15 | 0.07 | tr. | 0.25 | 14.9 | — | — | 23.5 | — | 0.005 | 0.04 | — | 0.003 | — | " |
| | 4 | 0.73 | 0.18 | 0.08 | tr. | 0.07 | 24.2 | — | — | 18.3 | — | 0.003 | 0.05 | — | — | Ce: 0.005 | " |
| | 5 | 0.45 | 0.13 | 0.07 | tr. | 0.08 | 12.5 | — | 4.5 | 10.5 | — | 0.003 | 0.03 | 0.007 | — | — | " |
| | 6 | 0.73 | 0.22 | 0.07 | tr. | 0.07 | 20.3 | — | — | 19.8 | — | 0.001 | 0.04 | — | — | Nb: 0.75 | " |
| Reference alloy | 7 | tr. | tr. | 0.18 | tr. | 0.07 | 20.2 | — | — | 20.3 | — | 0.003 | 0.02 | 0.015 | — | — | " |
| | 8 | 0.32 | 0.39 | tr. | tr. | 0.07 | 20.1 | — | — | 19.8 | — | 0.003 | 0.01 | 0.012 | — | — | " |
| | 9 | tr. | tr. | tr. | 0.54 | 0.07 | 19.8 | — | — | 19.6 | — | 0.003 | 0.02 | — | — | — | " |
| | 10 | tr. | 0.18 | 0.21 | tr. | 0.05 | 19.9 | — | — | 19.7 | — | 0.003 | 0.02 | — | — | — | " |
| | 11 | tr. | 0.76 | 0.22 | tr. | 0.002 | 20.5 | — | — | 19.7 | — | 0.004 | 0.01 | — | — | — | " |
| | 12 | 0.39 | tr. | 0.21 | tr. | 0.08 | 20.3 | — | — | 19.8 | — | 0.002 | 0.04 | — | — | — | " |
| | 13 | 1.31 | tr. | 0.21 | tr. | 0.07 | 20.8 | — | — | 19.5 | — | 0.001 | 0.03 | — | — | Ce: 0.004 | " |

Table 4-continued

| Alloy specimen No. | Chemical composition (wt. %) | | | | | | | | | | | | | | Other elements | Ni |
|---|---|---|---|---|---|---|---|---|---|---|---|---|---|---|---|---|
| | Mn | Si | Al | Ti | C | Cr | Fe | Mo | W | Co | B | Zr | Mg | Ca | | |
| 14 | 0.81 | 0.73 | 0.20 | tr. | 0.07 | 20.3 | — | — | 20.1 | — | 0.002 | 0.03 | — | — | — | " |
| 15 | tr. | tr. | tr. | tr. | 0.05 | 20.1 | — | — | 19.8 | — | 0.001 | 0.04 | — | — | — | " |
| 16 | 0.81 | tr. | tr. | tr. | 0.04 | 19.8 | — | — | 19.6 | — | 0.001 | 0.02 | — | — | — | " |
| 17 | tr. | 0.72 | tr. | tr. | 0.07 | 19.9 | — | — | 19.7 | — | 0.002 | 0.02 | — | — | — | " |
| 18 | 0.56 | 0.52 | 0.31 | tr. | 0.08 | 21.3 | 17.86 | 8.99 | 0.57 | 0.79 | — | — | — | — | — | " |
| 19 | tr. | 0.43 | 1.20 | 0.35 | 0.03 | 20.5 | — | 8.5 | — | 12.0 | — | — | — | — | Nb +Ta: 3.42 | " |

In the aforementioned high-temperature corrosion test, each of said alloy specimens was placed in a retort of 15 mm in inside diameter made of quartz, and said retort was heated while passing a high-purity helium gas (99.995% in purity) commercially available at a rate of 200 cc per minute, and after holding the specimen at 1,000° C. for 100 hours, the specimen was cooled in the retort.

As shown in Table 5, almost no difference in the chemical composition of the helium gas was observed between the inlet and the outlet of said retort.

Table 5

| Composition | He gas (p.p.m.) | |
|---|---|---|
| | Inlet | Outlet |
| $H_2$ | <5 | <5 |
| CO | <1 | <1 |
| $CO_2$ | <5 | <5 |
| $CH_4$ | <5 | <5 |
| $H_2O$ | 0.90 ~ 1.10 | 0.87 ~ 0.96 |
| $N_2$ | <4 | <4 |
| $O_2$ | <1 | <1 |

In said high-temperature corrosion test, each of the alloy specimens was examined as to the following four items:

(1) Conditions of formation of an oxide film through visual observation, particularly, as to whether oxide film is spalled off or not;

(2) Oxidation increment of the alloy specimens before and after the high-temperature corrosion test;

(3) Shape of surface oxides through scanning-type electron microphotographs; and (4) State of an oxide layer resulting from cutting and polishing after an electrolytic copper plating of an oxide film, presence of selective oxidation of grain boundaries, and the state of internal oxidation.

The results of examinations made on the aforementioned items (1) to (4) are shown in Table 6.

As is clear from Table 6, no spalling occurred on the oxide films formed on alloy specimens Nos. 1 to 6 within the scope of the present invention. On the contrary, however, in reference alloy specimens Nos. 7 to 19 outside the scope of the present invention, spalling of the oxide films occurred more or less in almost all cases with the exception of only the specimens Nos. 14, 18, and 19 which had no spalling of the oxide films.

Table 6

| Alloy specimen | | Spalling of oxide film | Oxidation increment (mg/cm$^2$) | Formation of whisker crystals | Depth of selective oxidation of grain boundaries ($\mu$) | internal oxidation |
|---|---|---|---|---|---|---|
| Alloy of this invention | 1 | None | 0.06 | Slight | None | Slight |
| | 2 | None | 0.05 | Slight | None | None |
| | 3 | None | 0.03 | Very slight | None | None |
| | 4 | none | 0.03 | Very slight | None | None |
| | 5 | None | 0.02 | Very slight | None | None |
| | 6 | None | 0.04 | Slight | None | None |
| Reference alloy | 7 | Serious | 0.11 | None | 120 | Slight |
| | 8 | Very slight | 0.09 | Slight | None | Slight |
| | 9 | Serious | 0.03 | None | 30 | Slight |
| | 10 | Serious | 0.02 | None | 65 | None |
| | 11 | Serious | 0.32 | Serious | 11 | Serious |
| | 12 | Slight | 0.09 | None | 35 | Slight |
| | 13 | Very slight | 0.06 | None | 50 | Slight |
| | 14 | none | 0.01 | Slight | 10 | Slight |
| | 15 | Serious | 0.18 | None | 10 | None |
| | 16 | Slight | 0.19 | None | None | None |
| | 17 | Serious | −0.19 | Serious | 80 | Serious |
| | 18 | None | 0.28 | Serious | 35 | Serious |
| | 19 | None | 0.19 | Serious | 40 | Serious |

Figure 5A:
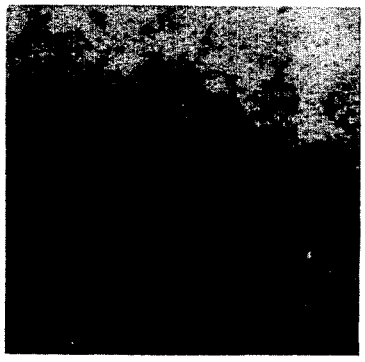
FIG. 5(*a*) is a photograph showing the state of the surface of a specimen of an alloy of the present invention, take in a high-temperature corrosion test.
Figure 5B:
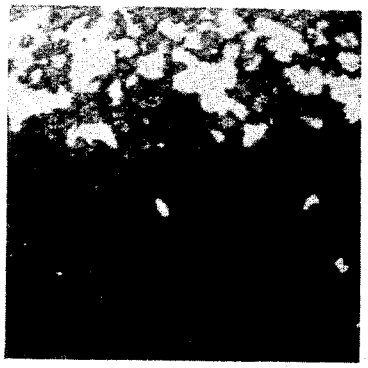

FIG. 5(*a*) and FIG. 5(*b*) are photographs showing the state of surface of alloy specimen No. 1 of the present invention and the reference alloy specimen No. 7 outside the scope of the present invention, respectively, taken in said high-temperature corrosion test. As shown in FIG. 5(*a*), no spalling of the oxide film occurred on alloy specimen No. 1. In contrast, however, whitish spots representing the spalling of the oxide film were observed on reference alloy specimen No. 7. Thus, the rate of oxidation becomes slower with the elapse of time in the case of the alloy of the present invention because the oxide film is not spalled off.

Figure 6:
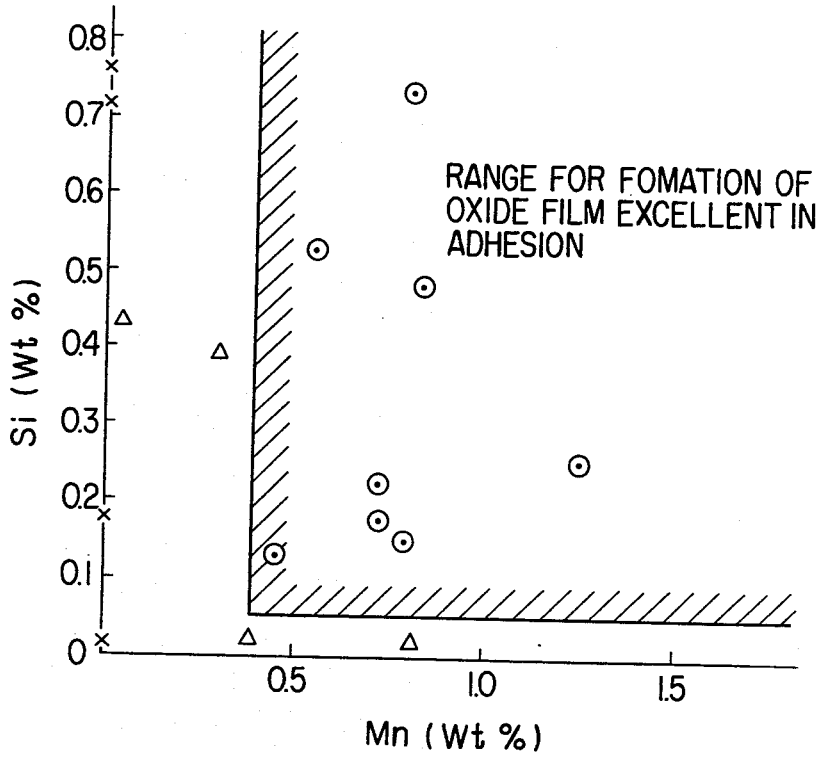
FIG. 6 is another drawing illustrating the effect of manganese and silicon on the occurrence of spalling of an oxide film formed on the surface of an alloy.

FIG. 6 shows the effect of manganese and silicon on the occurrence of spalling of an oxide film formed on the surface of an alloy, as derived from said high-temperature corrosion test. In FIG. 6, plots "*o*" represent no-existence of spalling of an oxide film, plots "*x*" represent serious spalling of an oxide film, and plots "Δ", slight spalling of an oxide film. As described above with respect to FIG. 2 in Example 1, the addition of manganese alone can serve to prevent the spalling of the oxide film though only slightly as shown also in FIG. 6. However, by the combined addition of manganese and silicon, the spalling of oxide film can be far more effectively prevented. In particular, in the range of manganese contents of 0.4% and over, and of silicon contents of 0.05% and over, no spalling of the oxide film is observed.

Now, the oxidation increment as observed in the high-temperature corrosion test is considered. As shown in Table 6, the oxidation increments in alloy specimens Nos. 1 to 6 of the present invention are on a very low level. In contrast, among reference alloy specimens Nos. 7 to 19 outside the scope of the present invention, only specimens Nos. 9, 10 and 14 show small oxidation increments and all the remaining reference alloy specimens show large oxidation increments. In view of this fact, it is apparent that the alloys of the present invention have excellent corrosion resistance at high-temperatures in an atmosphere of a low oxidizing potential. In measuring oxidation increments, oxide films spalled off and dispersed were not collected for weighing. The values shown in Table 6 are therefore somewhat lower than the actual oxidation increments.

Figure 7:
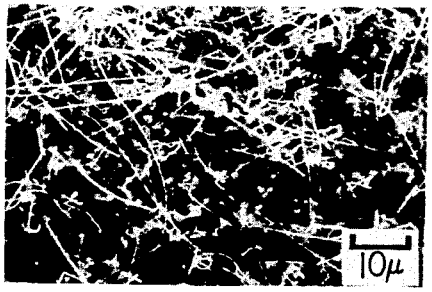
FIG. 7 is a scanning-type electron microphotograph showing the shape of oxides formed on the surface of a specimen of another reference alloy outside the scope of the present invention, taken in a high-temperature corrosion test.

As a result of an examination by a scanning-type electron microscope of the shape of oxide films formed on the surfaces of alloy specimens in said high-temperature corrosion test, as shown in Table 6, while the alloy specimens Nos. 1 to 6 of the present invention showed whisker crystals in only a slight amount, many whisker crystals grew in the reference alloy specimens outside the scope of the present invention, particularly in specimens Nos. 11, 17, 18 and 19. FIG. 7 is a microphotograph photograph showing the shape of oxides formed on the surface of reference alloy specimen No. 11 taken by a scanning-type electron miscroscope, from which many whisker crystals are observed.

It was also noted that said whisker crystals did not grow on the alloy specimens placed near the helium gas inlet of the retort but they grew on the surfaces and edges of the alloy specimens placed near the helium gas outlet. Judging from this fact, it is considered that oxides on the alloy specimens are once sublimated in the retort and carried to the vicinity of the gas outlet by the gas stream, where they grow into whisker crystals while being evaporated and deposited onto the alloy specimens. Because an alloy having many whisker crystals tends to cause sublimation, such an alloy is considered to be poor in corrosion resistance at hightemperatures.

Furthermore, as is evident from the results shown in Tables 4 and 6, there is a close relationship between the silicon content and the occurrence of whisker crystals. For instance, when the silicon content is only trace as in the case of reference alloy specimens Nos. 7, 9, 12, 13, 15 and 16 outside the scope of the present invention, no whisker crystal occurred. From these results, it is noted that when the silicon content exceeds 0.1%, growth of whisker crystals becomes apparent, and this trend becomes more remarkable as the silicon content increases. In view of the foregoing, when the other characteristics are ignored, the least possible silicon content is desirable. As is evident from Tables 4 and 6, furthermore, alloy specimens Nos. 3, 4, and 5 with silicon contents of 0.2% and under showed no spalling of the oxide films, with very slight formation of whisker crystals and oxidation increments, and indicated no selective oxidation of grain boundaries nor internal oxidation at all, as described below. This suggests the necessity of bringing the silicon content within the range of from 0.05 to 0.5%, preferably within the range of from 0.05 to 0.2%.

The selective oxidation of grain boundaries and internal oxidation of the alloy specimens, as observed at a center cross-section in the high-temperature corrosion test, are now considered. As is apparent from Table 6, almost no selective oxidation of grain boundaries nor internal oxidation was observed in the alloy specimens Nos. 1 to 6 of the present invention. In contrast, all of the reference alloy specimens Nos. 7 to 19 outside the scope of the present invention with the exception of only Nos. 8 and 16, had a serious selective oxidation of grain boundaries, and reference alloy specimens Nos. 11 and 17 to 19 showed a serious internal oxidation.

Furthermore, it is understood from the results given in Tables 4 and 6 that there is a close relationship between the selective oxidation of grain boundaries and the aluminum and titanium contents. More specifically, when the titanium content exceeds 0.05%, as in reference alloy specimens Nos. 9 and 19, the selective oxidation of boundaries occurs, irrespective of the presence of such elements as aluminum, silicon and manganese. Even if the titanium content is 0.05% at the maximum, the selective oxidation of grain boundaries occurs, as in reference alloy specimens Nos. 7, 10 and 13, when aluminium content is over 0.05% and manganese and silicon are not present, but when the manganese and silicon contents are 0.4% and 0.05% at the minimum, respectively, no selective oxidation of boundaries occurs even if the aluminium content is 0.2% at the maximum, for example as in alloy specimen No. 2 of the present invention.

Figure 8A:
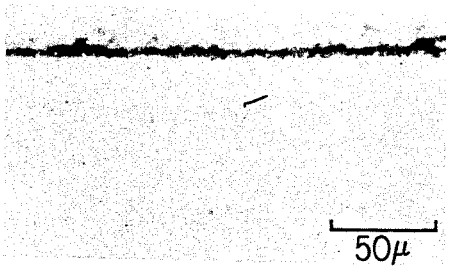
FIG. 8(*a*) is a photograph showing the cross-sectional structure of a specimen of another alloy of the present invention near the surface of the center portion, taken in a high-temperature corrosion test.
Figure 8B:
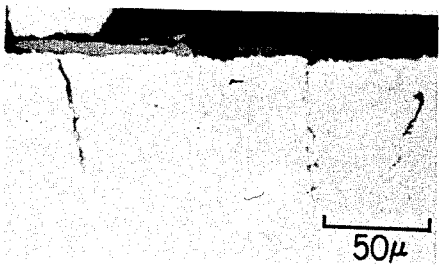

FIGS. 8(*a*) and 8(*b*) are photographs showing the cross-sectional structures near the surfaces of the center portions of alloy specimen No. 1 and reference alloy specimen No. 7 outside the scope of the present invention, respectively, taken in said high-temperature corrosion test. As shown in FIG. 8(*a*), the oxide film of alloy specimen No. 1 of the present invention adheres tightly to the base metal and no selective oxidation along grain boundaries is observed. On the contrary, in the case of reference alloy specimen No. 7 the adherence of the oxide film to the base metal is poor with a partial spalling, and in addition, the grain boundaries are oxidized deeply into the interior, as shown in FIG. 8(*b*).

EXAMPLE 3

Alloy specimens Nos. 1 and 5 of the present invention and reference alloy specimens Nos. 7 and 18 outside the scope of the present invention shown in Table 4 were subjected to a high-temperature corrosion test under the same conditions as those for the aforementioned Example 2 using helium gas, with the exception of helium gas used in said Example 2 replaced by argon gas. As shown in Table 7, almost no difference in the chemical composition of the argon gas was observed between the inlet and the outlet of the retort in said test.

Table 7

| Composition | Ar gas (p.p.m.) Inlet | Outlet |
|---|---|---|
| $H_2$ | <1 | <1 |
| CO | — | — |
| $CO_2$ | <2 | <2 |
| $CH_4$ | <1 | <1 |
| $H_2O$ | 0.8 ~ 1.2 | 0.9 ~ 1.2 |
| $N_2$ | <5 | <5 |
| $O_2$ | <1 | <1 |

The results of said high-temperature corrosion tests are shown in Table 8.

Table 8

| Alloy Specimen No. | Alloy of this invention | | Reference alloy | |
|---|---|---|---|---|
| Item examined | 1 | 5 | 7 | 18 |
| Spalling of oxide film | None | None | Serious | None |
| Oxidation increment ($mg/cm^2$) | 0.053 | 0.025 | 0.14 | 0.23 |
| Formation of whisker crystals | Slight | Very slight | None | Serious |
| Depth of selective | | | | |

Table 8-continued

| Alloy Specimen No. | Alloy of this invention | | Reference alloy | |
|---|---|---|---|---|
| Item examined | 1 | 5 | 7 | 18 |
| oxidation of grain boundaries (μ) | None | None | 110 | 30 |

As is clear from Table 8, alloy specimens Nos. 1 and 5 showed better properties in all respects than reference alloy specimens Nos. 7 and 18.

EXAMPLE 4

Alloy specimens Nos. 1 and 5 and reference alloy specimens Nos. 7 and 18 shown in Table 4 were subjected to a high-temperature corrosion test under the same conditions as those for the aforementioned Example 2 using helium gas with the exception of the use of an inside diameter of the retort made of a quartz tube of 30 mm and a degree of vacuum in said retort of $10^{-4}$ mm Hg. The test results are shown in Table 9.

Table 9

| Alloy Specimen No. | Alloy of this invention | | Reference alloy | |
|---|---|---|---|---|
| Item examined | 1 | 5 | 7 | 18 |
| Spalling of oxide film | None | None | Slight | None |
| Oxidation increment ($mg/cm^2$) | −0.094 | −0.06 | −0.31 | −0.25 |
| Formation of whisker crystals | None | None | None | None |
| Depth of selective oxidation of grain boundaries (μ) | None | None | 5μ max | 5μ max |

As is apparent from Table 9, alloy specimens Nos. 1 and 5 of the present invention showed better properties in all respects than reference alloy specimens Nos. 7 and 18.

According to this invention, as mentioned above in detail, it is possible to obtain a nickel-base alloy excellent in corrosion resistance at high temperatures, which has an oxide film formed on the surface thereof not being spalled off, has a very slight corrosion by oxidation at high temperatures, and yet causes no selective oxidation of grain boundaries nor internal oxidation in an atmosphere of a low oxidizing potential, for example of an inert gas such as helium or argon or under vacuum, thus providing industrially useful effects.

What is claimed is:

1. A nickel-base alloy excellent in corrosion resistance at high temperatures, which consists essentially of, in weight percentage:

Carbon — 0.04 to 0.25%,

Chromium — 10.0 to 25.0%, at least one element selected from the group consisting of 0.1 to 30.0% iron, 0.1 to 25.0% tungsten, 0.1 to 10.0% molybdenum and 0.05 to 30.0% cobalt, the maximum thereof being 50%, Manganese — 0.4 to 1.5%, Silicon — 0.05 to 0.5%, Aluminium — 0.001 to 0.2%, Titanium — 0.001 to 0.05%, and Nickel and inevitable impurities — balance;

said alloy having excellent corrosion resistance at high temperatures in an atmosphere of a low oxidizing potential.

2. The alloy claimed in claim 1, where in said tungsten content is within the range of from 0.1 to 10.0%.

3. The alloy claimed in claim 1, characterized by further additionally containing, in weight percentage:

Boron — 0.001 to 0.05%

Zirconium — 0.01 to 0.1%, and at least one element selected from the group consisting of 0.001 to 0.02% magnesium, 0.001 to 0.05% calcium and 0.001 to 0.02% a rare earth element.

4. The alloy claimed in claim 2, characterized by further additionally containing, in weight percentage:

Boron — 0.001 to 0.05%

Zirconium — 0.01 to 0.1%, and

At least one element selected from the group consisting of 0.001 to 0.02% magnesium, 0.001 to 0.05% calcium and 0.001 to 0.02% a rare earth element.

5. The alloy claimed in claim 3, wherein the contents of the constituent elements are as follows:

Carbon — 0.04 to 0.25%,

Chromium — 10.0 to 25.0%,

Tungsten — 10.0 to 25.0%,

Molybdenum — 0.1 to 10.0%,

[Tungsten] + 2[molybdenum] up to a maximum of 25%,

Manganese — 0.4 to 1.5%,

Silicon — 0.05 to 0.5%,

Aluminium — 0.001 to 0.2%,

Titanium — 0.001 to 0.05%,

Boron — 0.001 to 0.05%,

Zirconium — 0.01 to 0.1%, at least one element selected from the group consisting of 0.001 to 0.02% magnesium, 0.001 to 0.05% calcium and 0.001 to 0.02% a rare earth element, and Nickel and inevitable impurities — balance.

6. The alloy claimed in claim 1, wherein said silicon content is 0.05 to 0.2% in weight percentage.

7. The alloy claimed in claim 2, wherein said silicon content is 0.05 to 0.2% in weight percentage.

8. The alloy claimed in claim 3, wherein said silicon content is 0.05 to 0.2% in weight percentage.

9. The alloy claimed in claim 4, wherein said silicon content is 0.05 to 0.2% in weight percentage.

10. The alloy claimed in claim 5, wherein said silicon content is 0.05 to 0.2% in weight percentage.

* * * * *

UNITED STATES PATENT AND TRADEMARK OFFICE

CERTIFICATE OF CORRECTION

PATENT NO. : 4,110,110

DATED : August 29, 1978

INVENTOR(S) : TATSUO KONDO et al

It is certified that error appears in the above-identified patent and that said Letters Patent are hereby corrected as shown below:

Title page, after "[73] Assignee: Mitsubishi Kinzoku Kabushiki Kaisha, Otemachi, Japan", insert ---and Japan Atomic Energy Research Institute, Tokyo, Japan---.

Title page, last line: replace "6 Drawing Figures" with -- 11 Drawing Figures---.

Column 1, line 49: after "of", insert ---the---.

Column 7, line 20: rewrite "alloy" as ---alloys---.

Column 7, Table 4, under column "C", third number from the bottom: replace "0.002" with ---0.001---.

Column 10, line 39: before "reference", delete "the".

Column 12, line 25: delete "outside the scope of the present invention".

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*